US007827837B2

(12) United States Patent
Huang et al.

(10) Patent No.: US 7,827,837 B2
(45) Date of Patent: Nov. 9, 2010

(54) ELECTRO-MECHANICAL LOCK ASSEMBLY

(75) Inventors: Lien-Hsi Huang, Kaohsiung (TW); Shin-Han Lin, Gangshan Township, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 63 days.

(21) Appl. No.: 12/390,824

(22) Filed: Feb. 23, 2009

(65) Prior Publication Data

US 2010/0212381 A1 Aug. 26, 2010

(51) Int. Cl.
*E05B 47/00* (2006.01)

(52) U.S. Cl. ..... 70/277; 70/218; 70/472; 70/149; 70/223; 70/279.1

(58) Field of Classification Search ..... 70/277, 70/280–282, 278.2, 278.3, 278.7, 279.1, 70/218, 222–224, 257, 188–190, 149, 472, 70/422; 292/142, 144, DIG. 27; 192/54.5; 464/161

See application file for complete search history.

(56) References Cited

U.S. PATENT DOCUMENTS

| | | | | | |
|---|---|---|---|---|---|
| 3,922,896 | A * | 12/1975 | Kagoura | 70/223 |
| 4,519,487 | A * | 5/1985 | Florin | 192/36 |
| 4,534,194 | A * | 8/1985 | Aydin | 70/278.2 |
| 4,645,050 | A * | 2/1987 | Ingenhoven | 192/36 |
| 5,178,026 | A * | 1/1993 | Matsumoto | 74/411 |
| 5,857,365 | A * | 1/1999 | Armstrong | 70/279.1 |
| 6,032,991 | A * | 3/2000 | Yeh | 292/336.3 |
| 6,053,293 | A * | 4/2000 | Sato et al. | 192/35 |
| 6,758,070 | B2 * | 7/2004 | Yu et al. | 70/107 |
| 6,807,834 | B2 * | 10/2004 | Tsai | 70/472 |
| 6,845,642 | B2 * | 1/2005 | Imedio Ocana | 70/277 |
| 7,516,633 | B1 * | 4/2009 | Chang | 70/472 |
| 7,543,469 | B1 * | 6/2009 | Tseng et al. | 70/472 |
| 7,770,423 | B2 * | 8/2010 | Wu | 70/218 |
| 2003/0121301 | A1 * | 7/2003 | Warmack | 70/257 |
| 2006/0131121 | A1 * | 6/2006 | Simm et al. | 192/54.5 |
| 2008/0121001 | A1 * | 5/2008 | Huang et al. | 70/91 |
| 2009/0229328 | A1 * | 9/2009 | Wu | 70/277 |

FOREIGN PATENT DOCUMENTS

| | | |
|---|---|---|
| TW | 479725 | 3/2002 |

* cited by examiner

*Primary Examiner*—Suzanne D Barrett
(74) *Attorney, Agent, or Firm*—Guice Patents PLLC

(57) ABSTRACT

An electro-mechanical lock assembly comprises a casing, an electric control mechanism and a manual control member. The casing has a base and an axial bore formed at the base. The manual control member is installed penetrating the axial bore of the casing and has a knob and a spindle coupled to the knob. The electric control mechanism is disposed within the casing and comprises a control switch, a rotatable member capable of actuating the control switch, a clutch gear capable of driving the rotatable member, a position member capable of controlling movement of the clutch gear and a motor capable of driving the clutch gear. The rotatable member is coupled to the spindle of the manual control member and has at least one first coupling portion. The clutch gear has at least one second coupling portion corresponding to the first coupling portion. The second coupling portion is capable of being moved along the spindle to catch with the first coupling portion of the rotatable member. The spindle is installed penetrating the axial bore of the casing and one end of the spindle is coupled to the rotatable member of the electric control mechanism.

17 Claims, 19 Drawing Sheets

ELECTRO-MECHANICAL LOCK ASSEMBLY

FIELD OF THE INVENTION

The present invention is generally relating to a lock device, more especially to an electro-mechanical lock assembly capable of performing locking/unclocking operations with electric and manual control manners.

BACKGROUND OF THE INVENTION

The electro-mechanical lock structure is known that mostly employs clutch mechanism to couple or isolate the power of electric and manual control for performing locking/unclocking functions by electric and manual control simultaneously, such as disclosed in R.O.C. patent No. 479,725 entitled "electro-mechanical lock". However, the clutch mechanism of the electric lockset mentioned above has a poor design of link that operating unsmooth or mutual interference may occur during electric and manual operations to cause great inconvenience for users.

SUMMARY

A primary object of the present invention is to provide an electro-mechanical lock assembly comprising a casing, an electric control mechanism and a manual control member. The casing has a base and an axial bore formed at the base. The manual control member installed penetrating the axial bore of the casing has a knob and a spindle coupled to the knob. The electric control mechanism disposed within the casing comprises a control switch, a rotatable member capable of actuating the control switch, a clutch gear capable of driving the rotatable member rotating, a position member capable of controlling movement of the clutch gear and a motor capable of driving the clutch gear. The rotatable member coupled to the spindle of the manual control member has at least one first coupling portion. The clutch gear has at least one second coupling portion that corresponds to the first coupling portion and is capable of being moved along the spindle to catch with the first coupling portion of the rotatable member. The spindle of the manual control member is installed penetrating the axial bore of the casing and one end of the spindle is coupled to the rotatable member of the electric control mechanism. Because of the link having excellent coordination among the clutch gear, the position member and the rotatable member in accordance with this embodiment, operating smooth for electric and manual controls can be widely improved.

DETAILED DESCRIPTION OF THE INVENTION

Figure 1A:
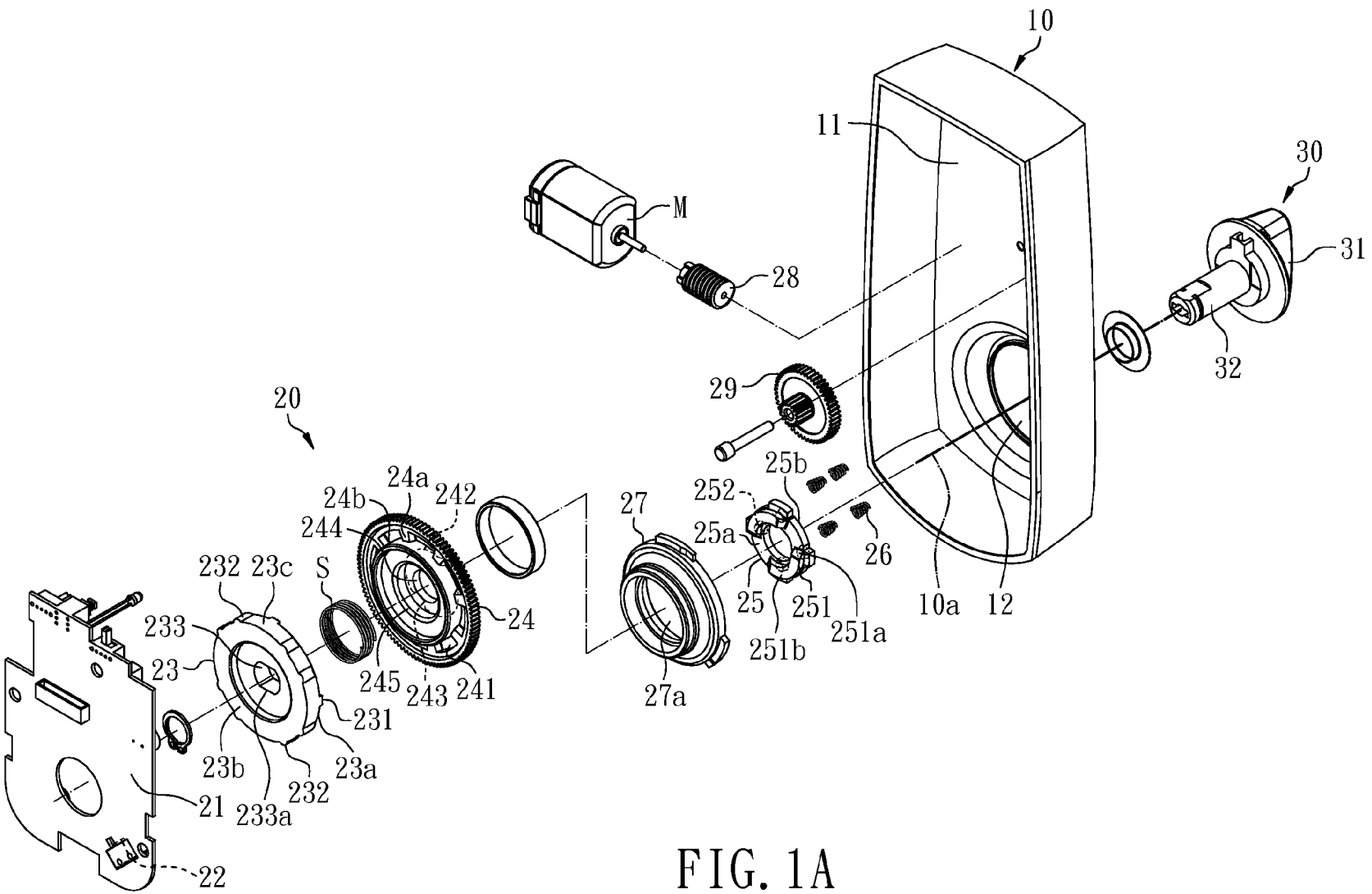
FIG. 1A is a perspective exploded view of an electro-mechanical lock assembly in accordance with a preferred embodiment of the present invention.
Figure 1B:
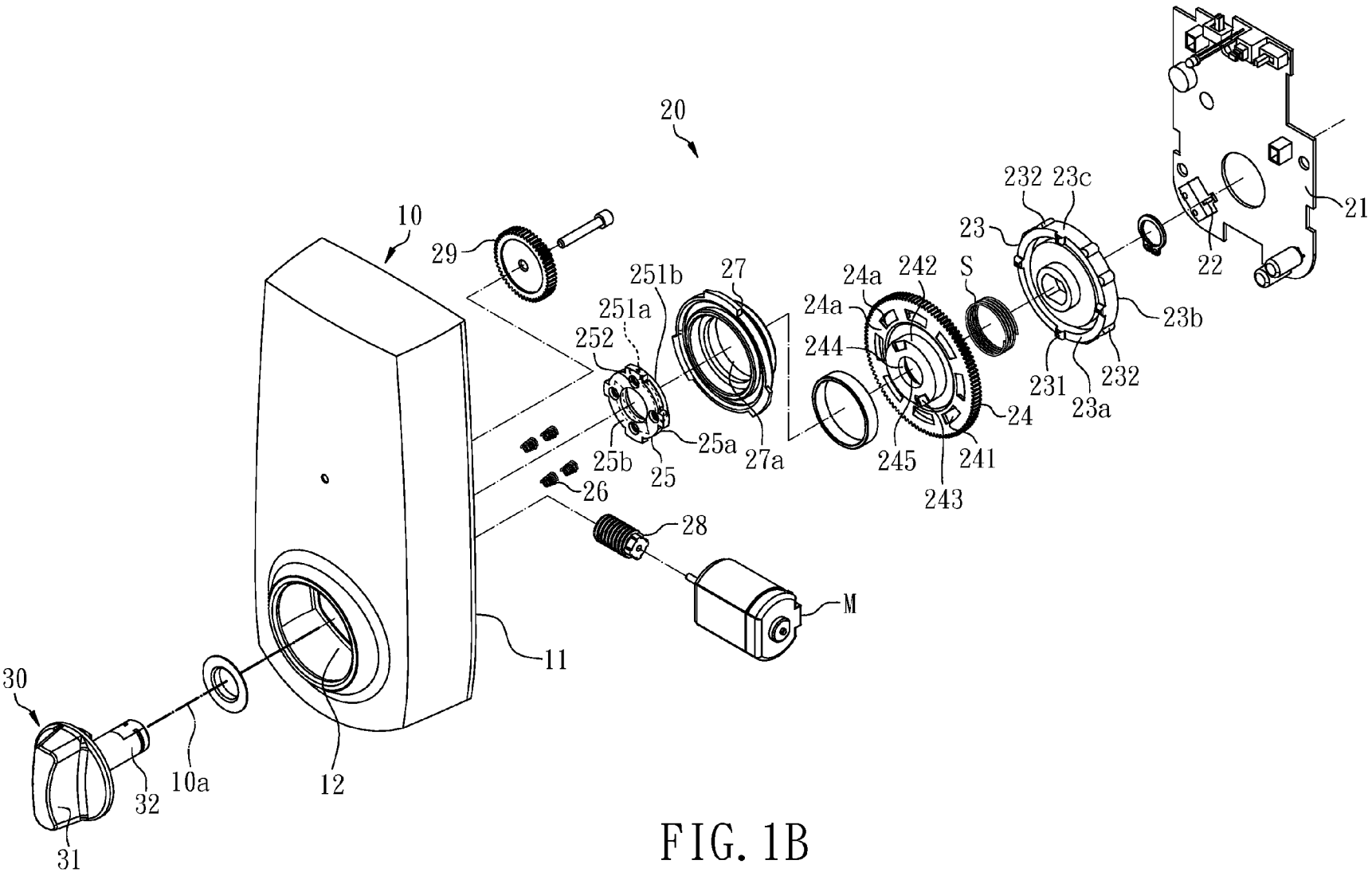
FIG. 1B is another perspective exploded view of the electro-mechanical lock assembly.
Figure 2:
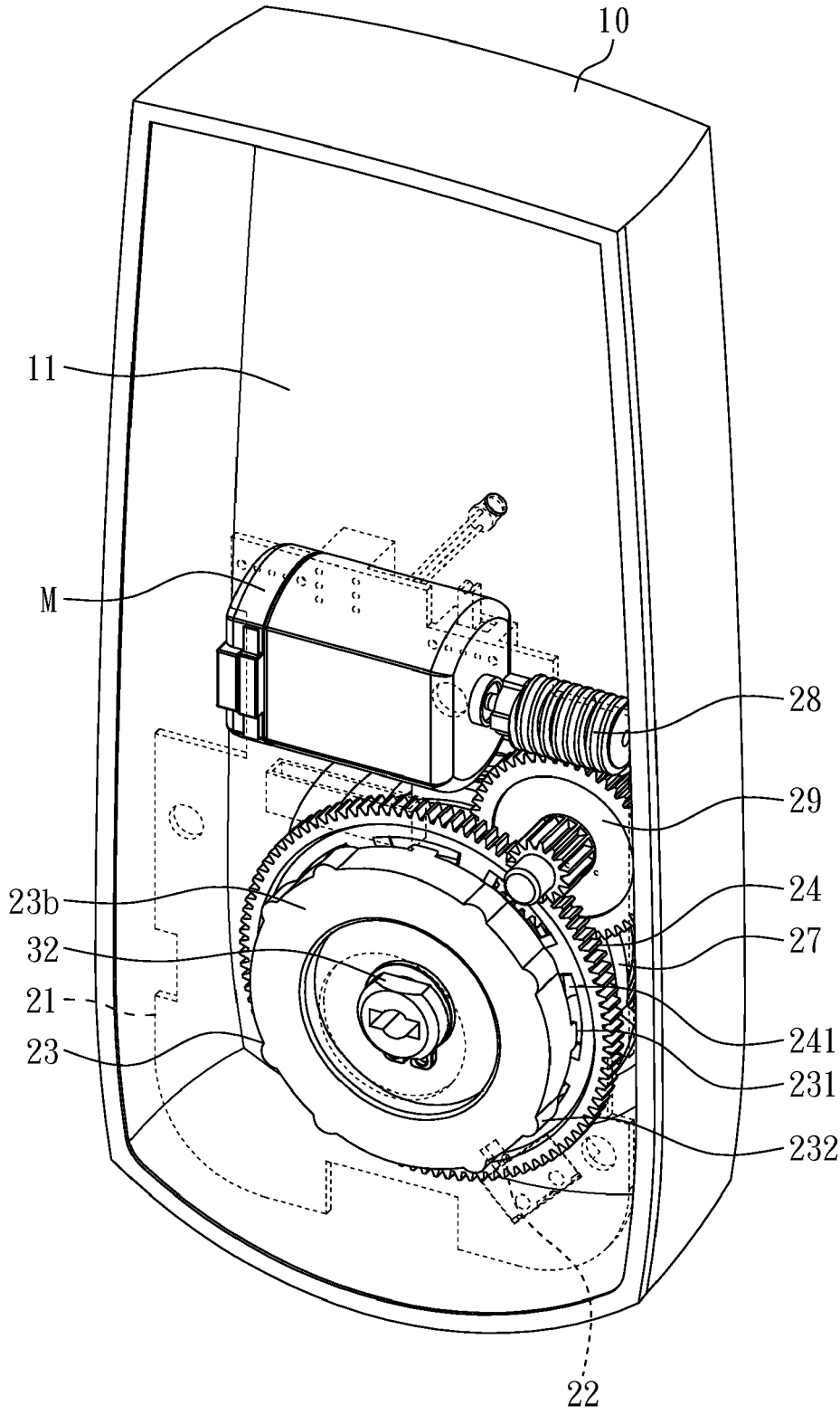
FIG. 2 is a perspective assembly view of the electro-mechanical lock assembly.
Figure 3:
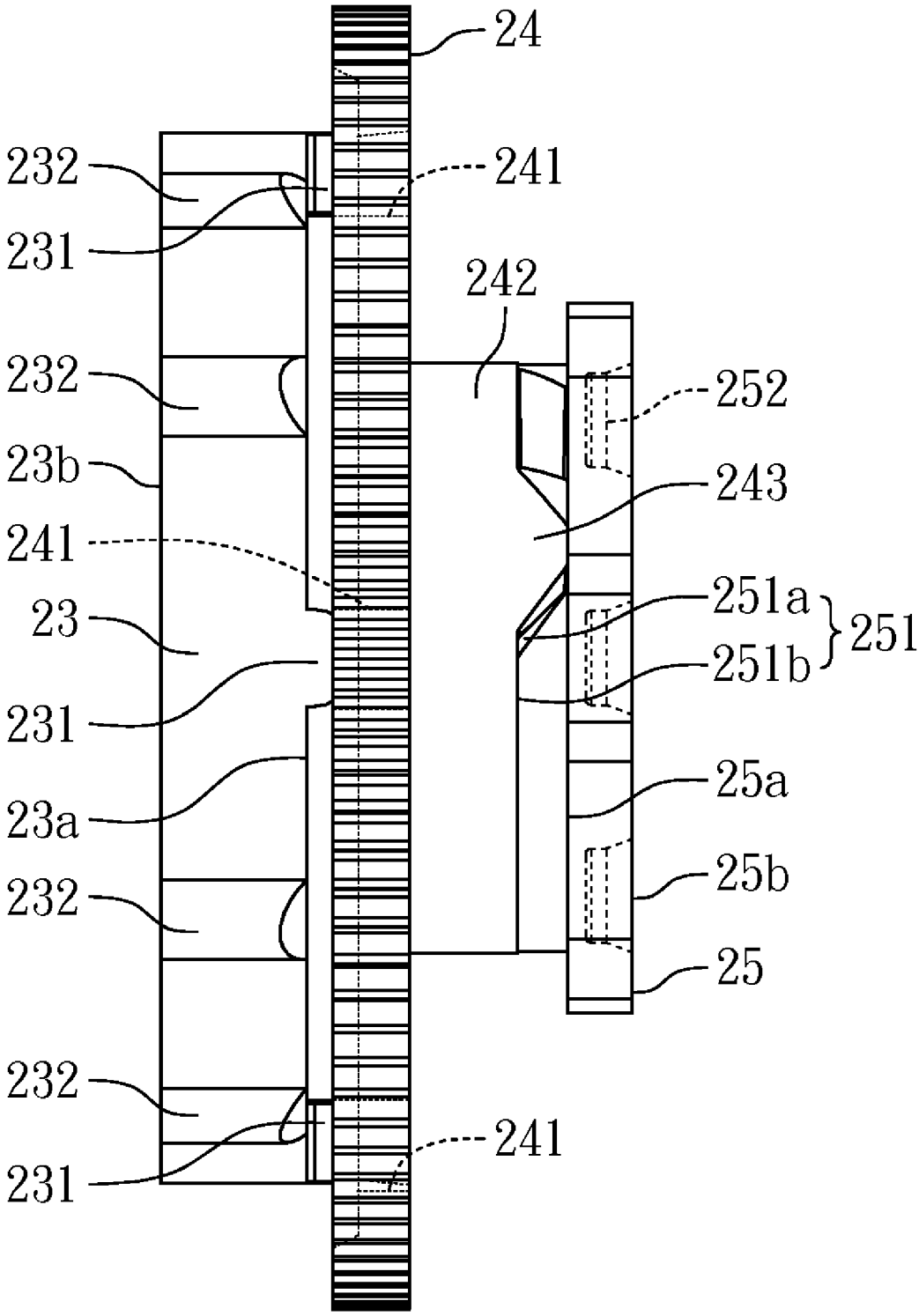
FIG. 3 is an assembly view of rotatable member, clutch gear and position member in accordance with a preferred embodiment of the present invention.

With reference to FIGS. 1A, 1B, 2 and 3, an electro-mechanical lock assembly in accordance with a preferred embodiment of the present invention comprises a casing 10, an electric control mechanism 20 and a manual control member 30. The casing 10 has a base 11, an axial bore 12 formed at the base 11 and an axis 10*a* disposed at center of the axial bore 12. The electric control mechanism 20 is disposed within the casing 10 comprising an circuit substrate 21, a control switch 22 disposed on the circuit substrate 21, a rotatable member 23 capable of actuating the control switch 22, a clutch gear 24 capable of driving the rotatable member 23 operating, a position member 25 capable of controlling movement of the clutch gear 24, at least one elastic member 26 disposed between the base 11 and the position member 25, a fixing base 27, a motor M capable of driving the clutch gear 24, a worm wheel 28 mounted on the motor M and a double-layer gear 29 in engagement with the worm wheel 28 and the clutch gear 24. The rotatable member 23 has a first surface 23*a* facing the clutch gear 24, a second surface 23*b* facing the control switch 22, a peripheral wall 23*c*, at least one first coupling portion 231 formed on the first surface 23*a*, a plurality of press protrusions 232 formed on the peripheral wall 23*c* and a catching slot 233. In this embodiment, the first coupling portion 231 is a bump projecting from the first surface 23*a* and the press protrusions 232 may actuate the control switch 22 in order during rotating process of the rotatable member 23. Besides, the catching slot 233 has a catching surface 233*a*. With reference again to FIGS. 1A, 1B, 2 and 3, the clutch gear 24 is movable axially along the axis 10*a* and has a first lateral 24*a* facing the rotatable member 23, a second lateral 24*b* facing the position member 25, at least one second coupling portion 241 corresponding to the first coupling portion 231, a ring protrusion 242 projecting from the second lateral 24*b*, at least one sloping block 243 and a central bore 244. In this embodiment, the second coupling portion 241 is formed at the outside of the central bore 244 and is a catching slot recessed from the first lateral 24*a*, and it is preferable for the catching slot to communicate with the first lateral 24*a* and the second lateral 24*b*. Moreover, the sloping block 243 is formed on the ring protrusion 242.

With reference to 1A, 1B, 3 and 6A, the position member 25 is disposed between the clutch gear 24 and the base 11 having a first side 25*a* facing the clutch gear 24, a second side 25*b* facing the base 11, at least one guiding block 251 projecting from the first side 25*a* and at least one chamfer 252 recessing from the second side 25*b*. In this embodiment, the guiding block 251 has a slope 251*a* and a top surface 251*b* and the sloping block 243 is capable of contacting against the slope 251*a* or the top surface 251*b* of the guiding block 251 when the clutch gear 24 rotates. With reference again to FIGS. 1A, 1B, 3 and 6A, one end of the elastic member 26 contacts against the position member 25 and another end contacts against the base 11, and preferably one end of the elastic member 26 is disposed at the chamfer 252 of the position member 25. The fixing base 27 affixes the position member 25 at the base 11 and has an opening 27*a* to expose the guiding block 251 of the position member 25 in this embodiment.

With reference again to FIGS. 1A, 1B, 3 and 6A, the electric control mechanism 20 further comprises a restoration spring S disposed between the rotatable member 23 and the clutch gear 24. Preferably, the clutch gear 24 has a cavity 245 recessed from the first lateral 24*a*, the restoration spring S is disposed at the cavity 245 and one end of the restoration spring S contacts against the rotatable member 23. Furthermore, the manual control member 30 has a knob 31 and a spindle 32 coupled to the knob 31 and installed penetrating the axial bore 12 of the base 11, and one end of the spindle 32 is coupled to the rotatable member 23 of the electric control mechanism 20. Besides, the electro-mechanical lock assembly of the present invention further comprises a battery set (not shown in the drawings) to provide electrical power needed for electric control operation in this embodiment.

Figure 4A:
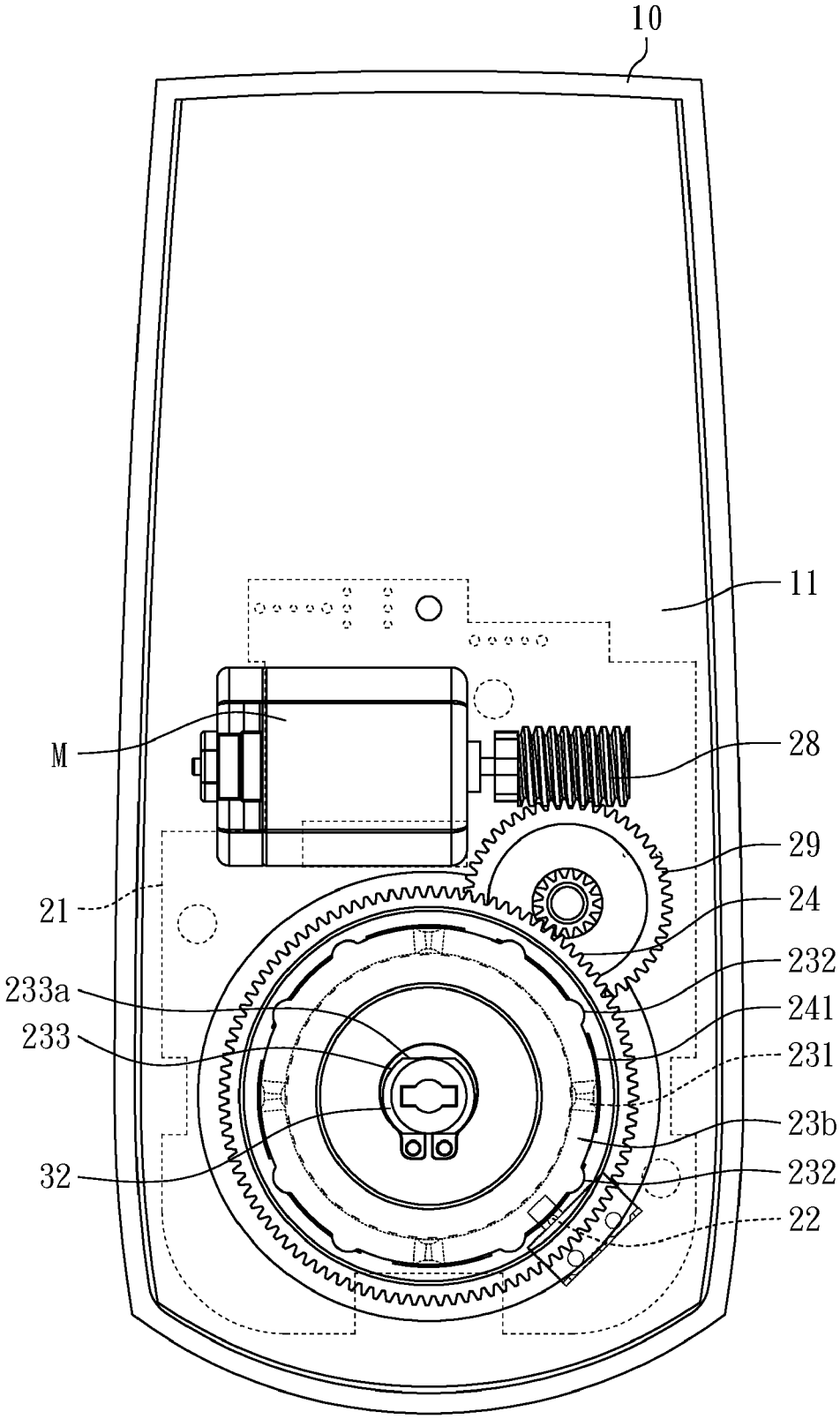
FIG. 4A-4C is motion view of locking the electro-mechanical lock assembly with manual control manner.
Figure 4B:
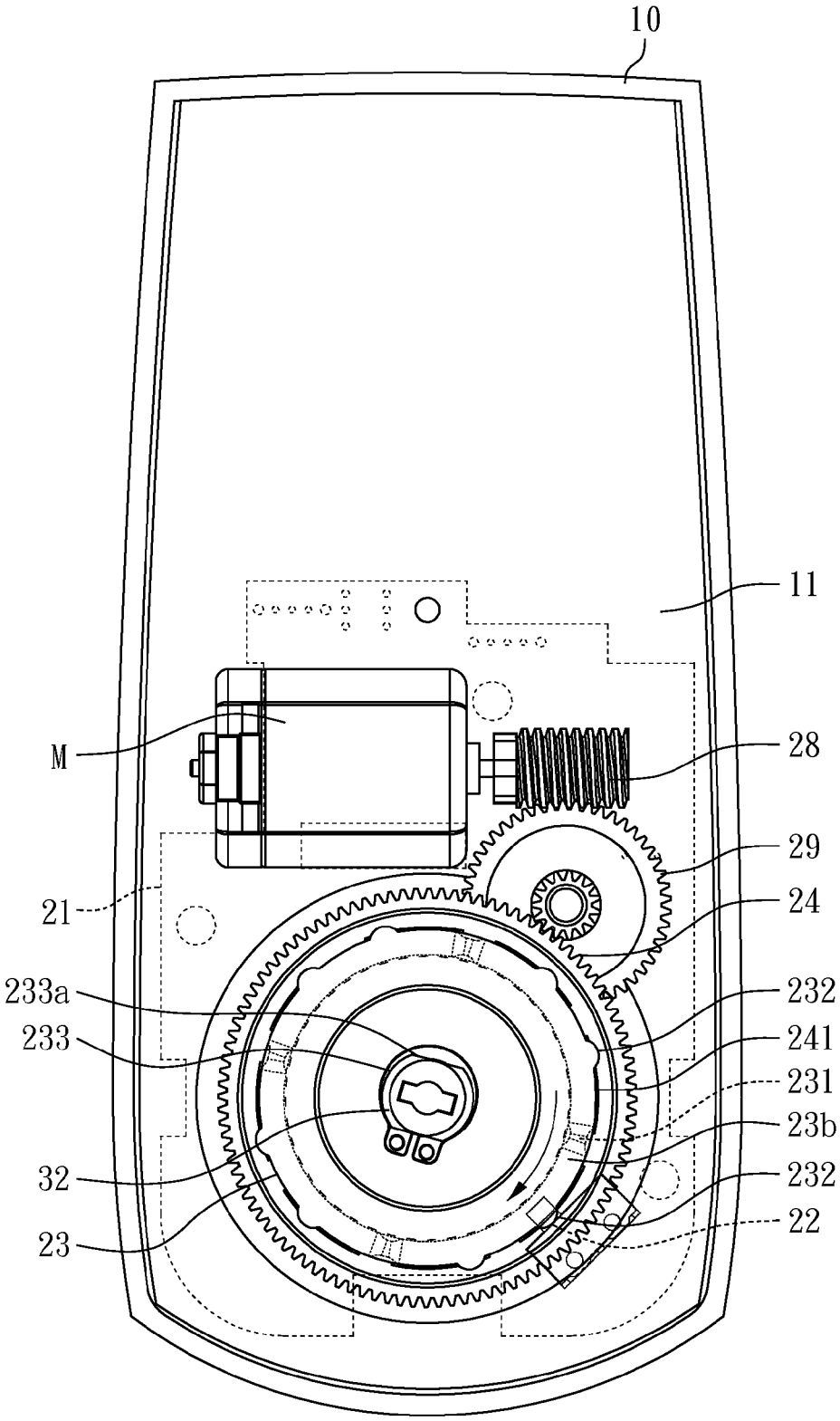
Figure 4C:
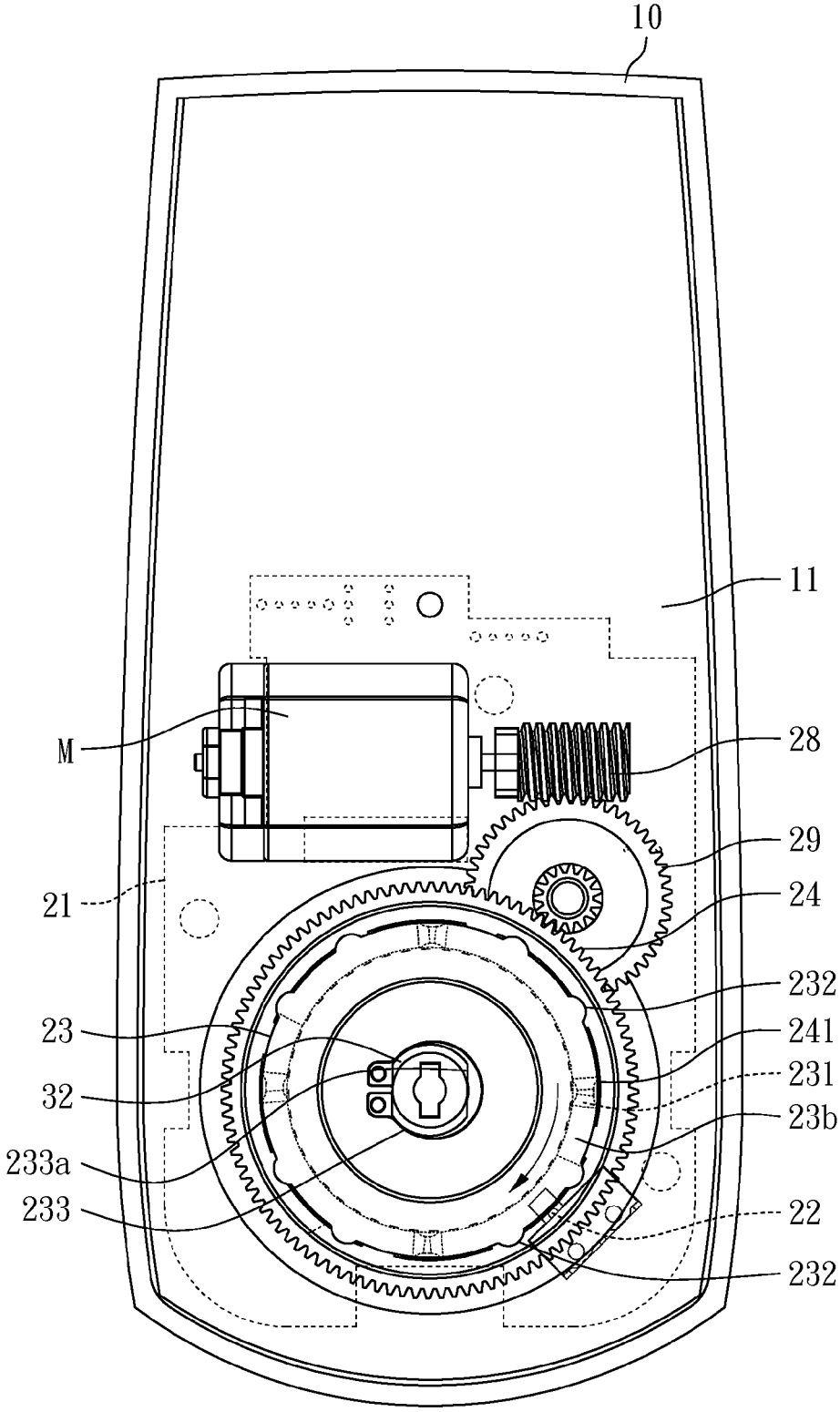

With reference to FIG. 4A-4C, an action about that the electro-mechanical lock assembly performs locking operation with manual control manner is shown. First, FIG. 4A shows elements of the electro-mechanical lock assembly in unlocking state, in which at least one press protrusion 232 of the rotatable member 23 corresponds to the control switch 22 and one end of the spindle 32 of the manual control member 30 is caught in the catching bore 233 of the rotatable member 23. In this embodiment, the electro-mechanical lock assembly is turned clockwise to perform locking operation, or it may also be modified to turn counterclockwise in another case. Next, with reference to FIG. 4B, when the manual control member 30 is turned clockwise, one end of the spindle 32 will contact against the catching surface 233*a* of the catching bore 233 to drive the rotatable member 23 to rotate so at least one press protrusion 232 of the rotatable member 23 actuates the control switch 22 first time. Then, with reference to FIG. 4C, when the manual control member 30 is turned to a predetermined angle, another press protrusion 232 of the rotatable member 23 will actuate the control switch 22 second time to switch the electro-mechanical lock assembly to locking state. Since the manual control member 30 is linked with a cylinder lock (not shown in the drawings) in this embodiment, it is designed to have a maximum turning angle 90°, and similarly, it merely needs to turn the manual control member 30 90° counterclockwise for switching the electro-mechanical lock assembly to unlocking state with manual control manner.

Figure 5A:
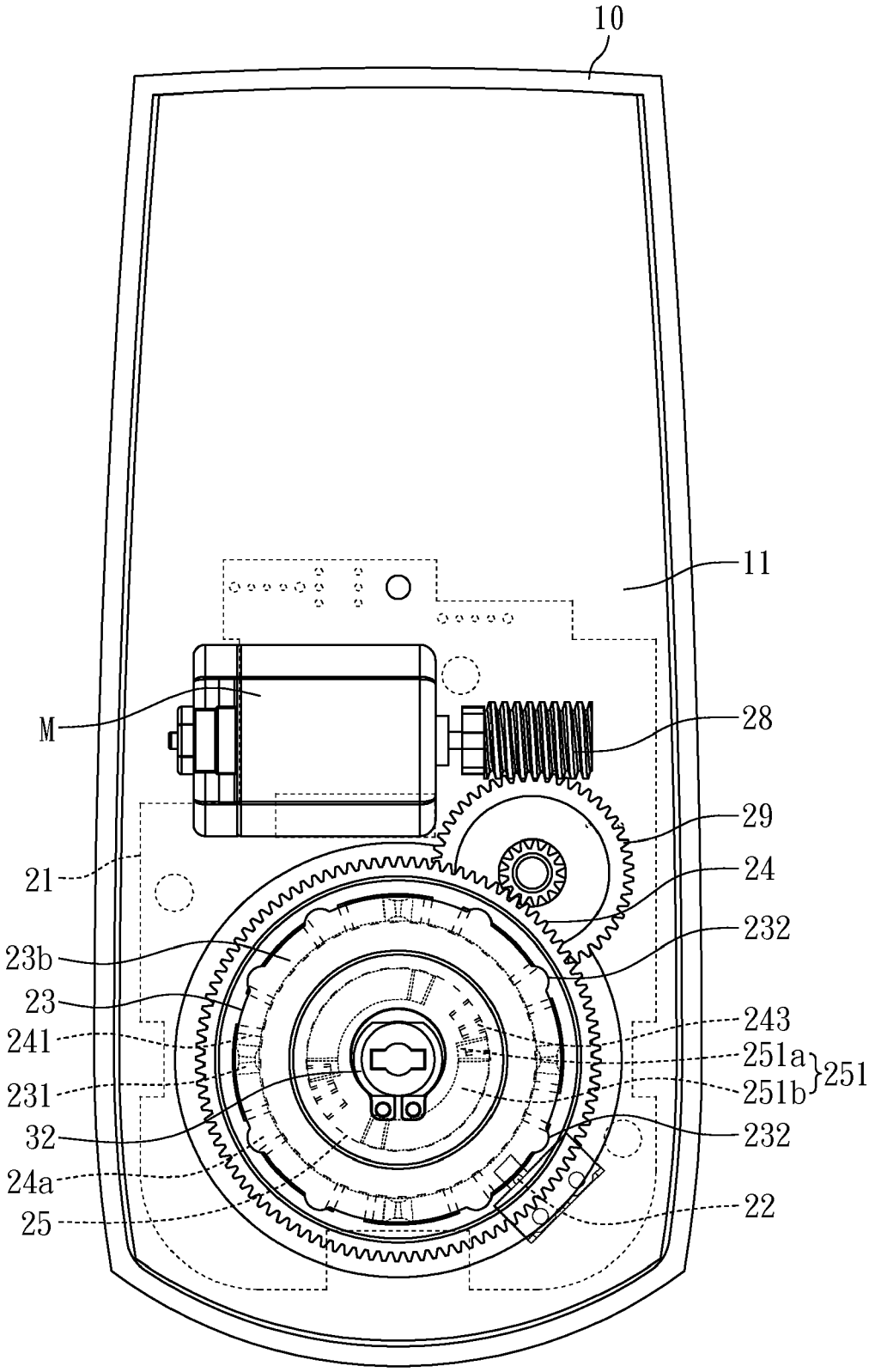
FIG. 5A-5F is a motion view of locking the electro-mechanical lock assembly with electric control manner.
Figure 5B:
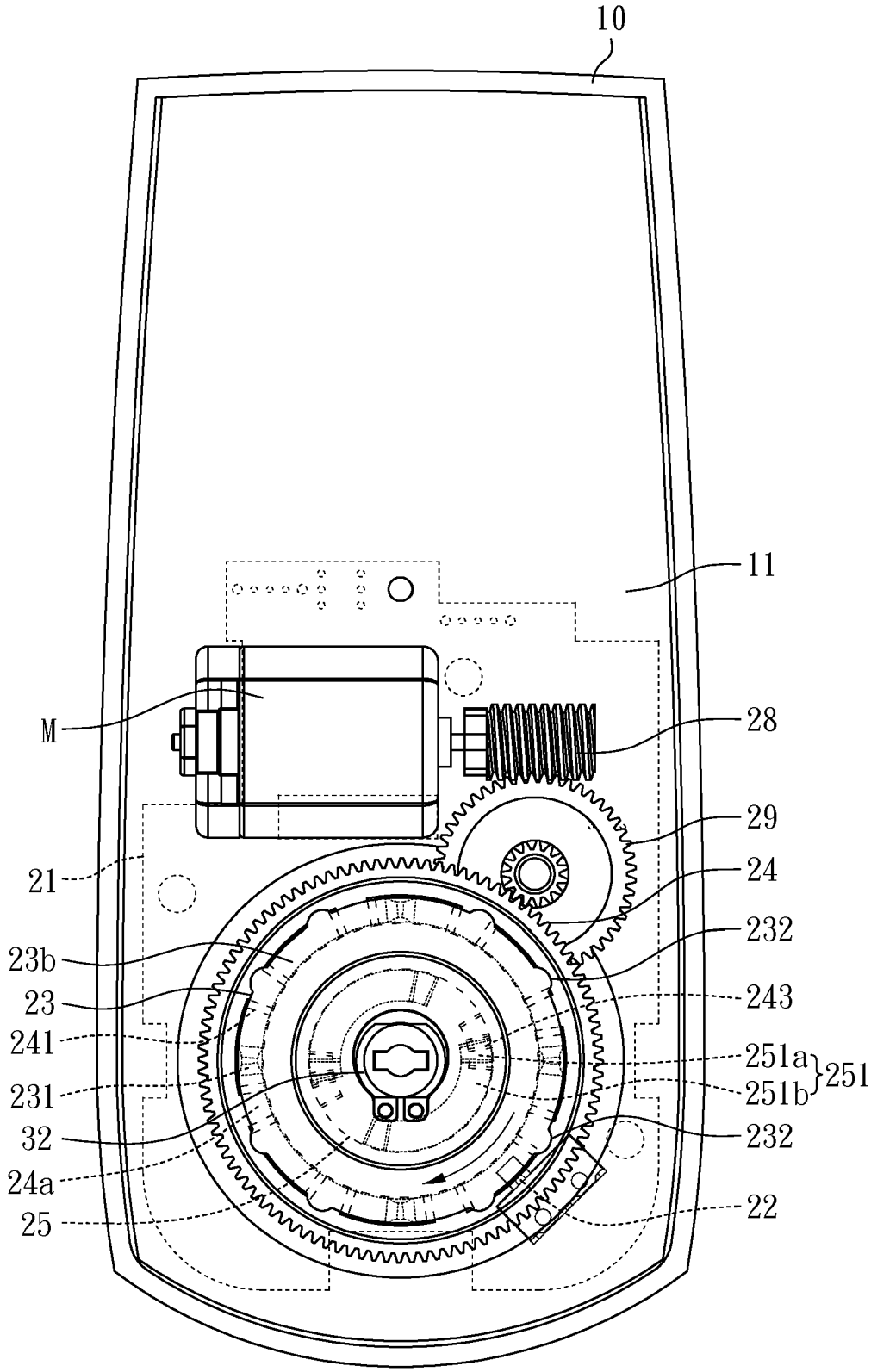
Figure 5C:
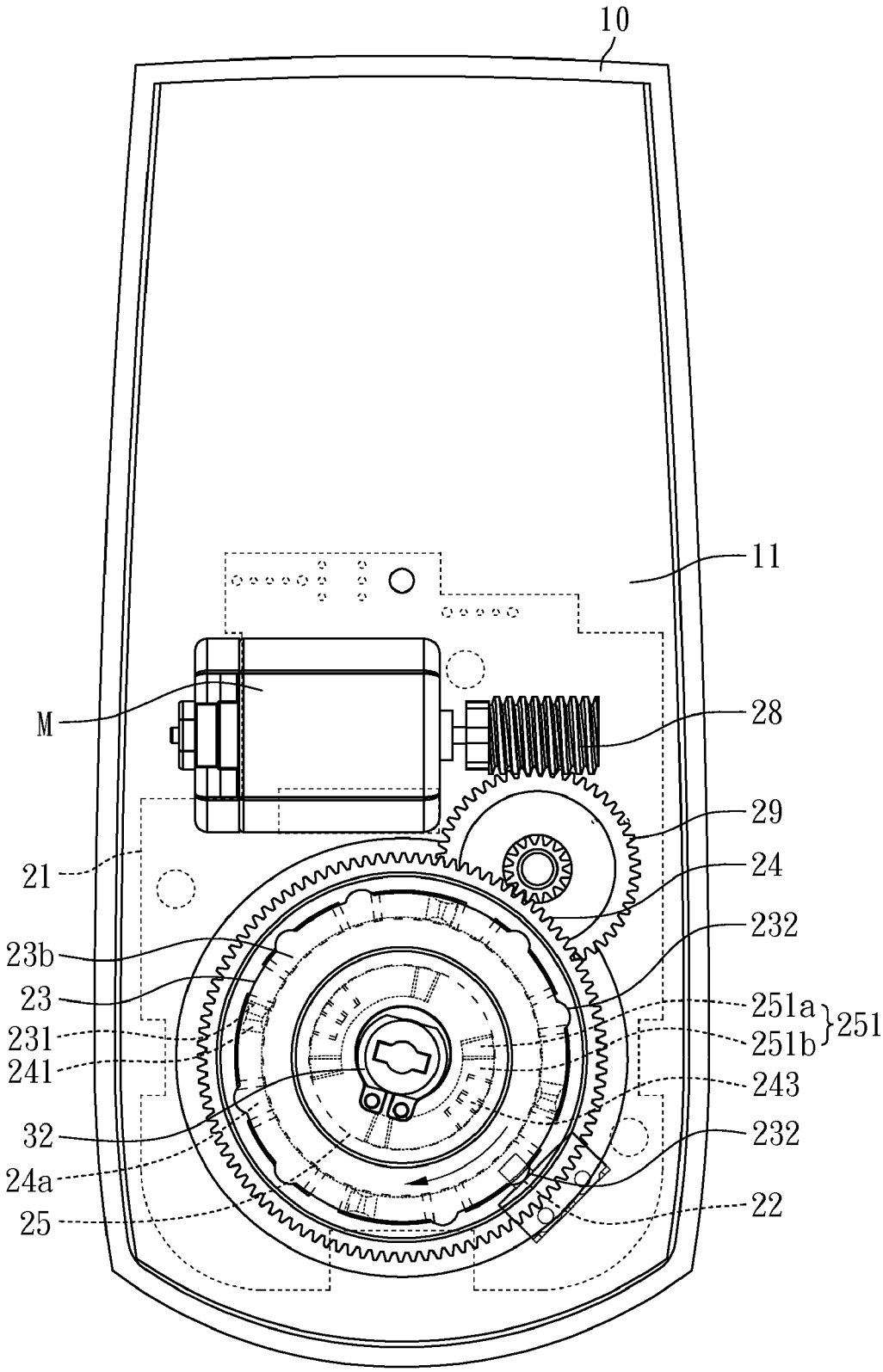
Figure 5D:
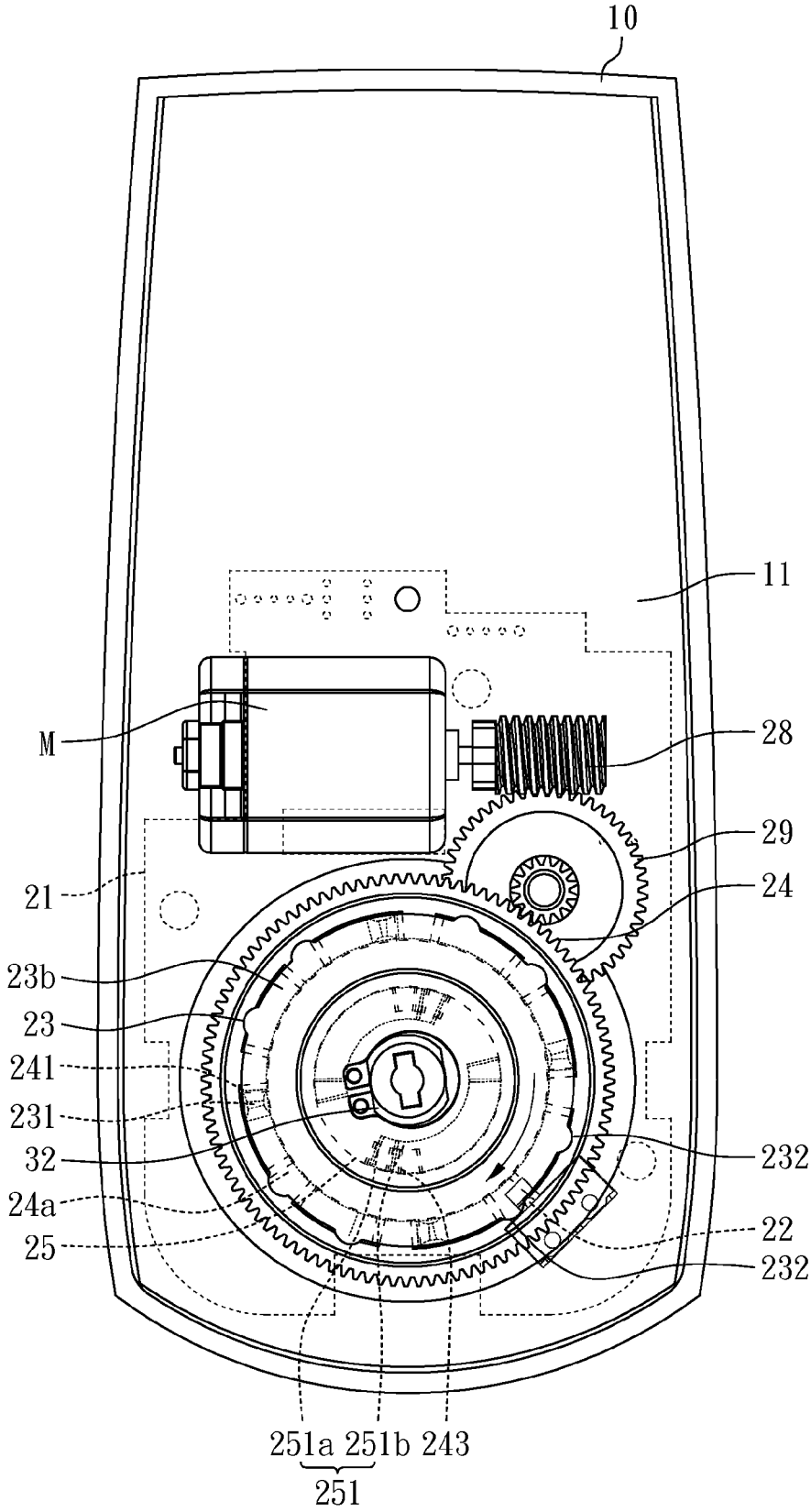
Figure 5E:
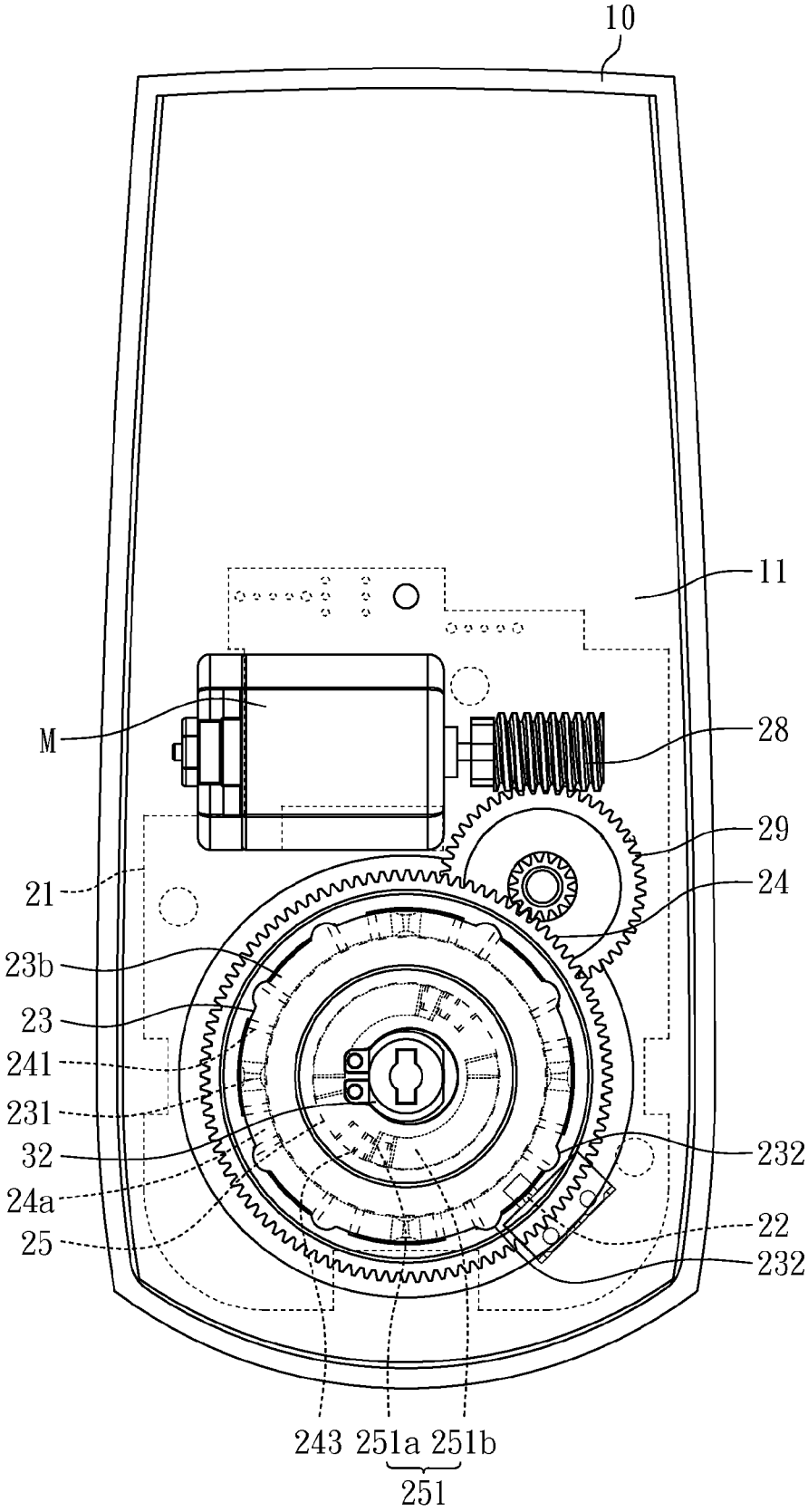
Figure 5F:
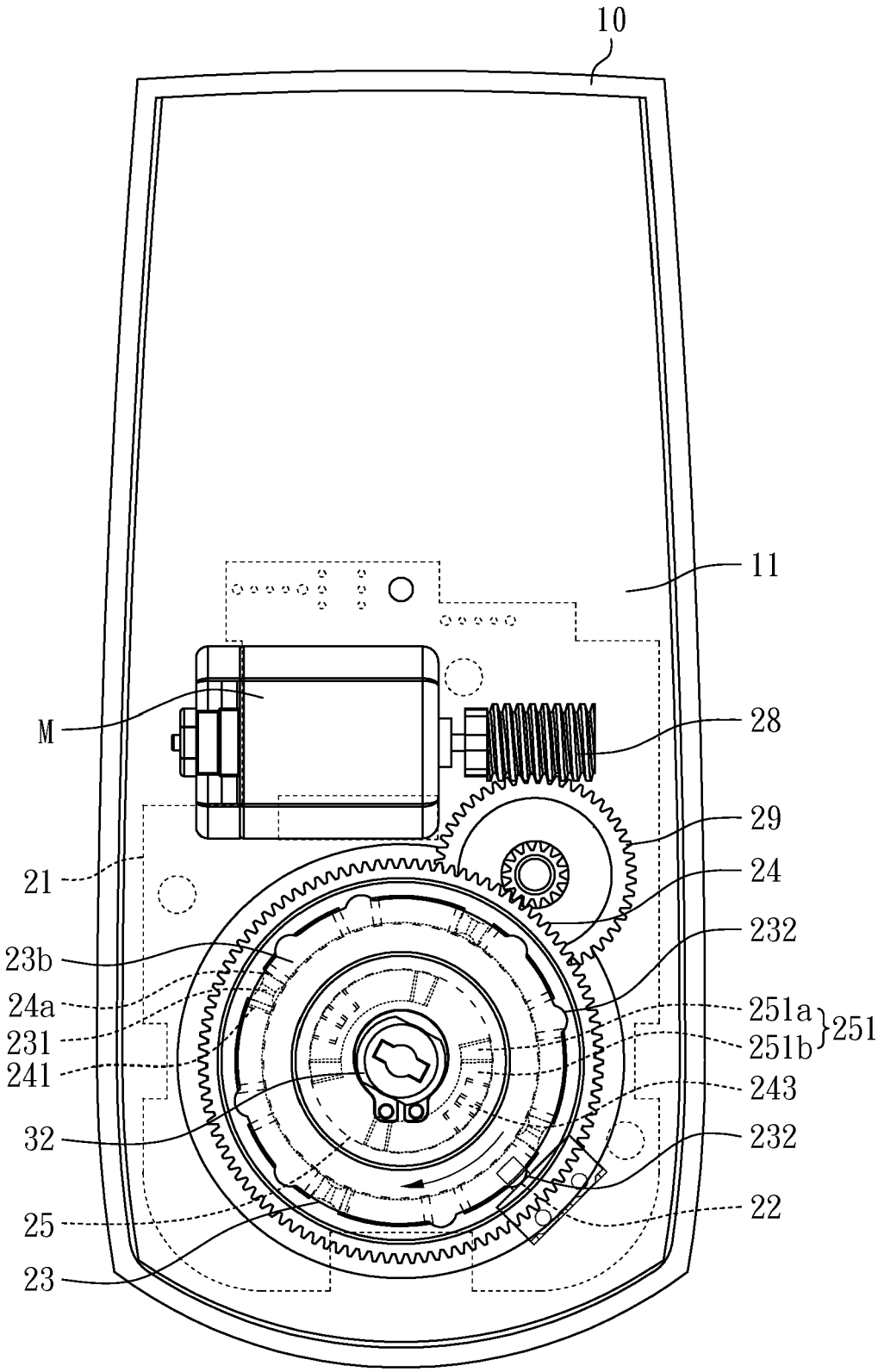
Figure 6A:
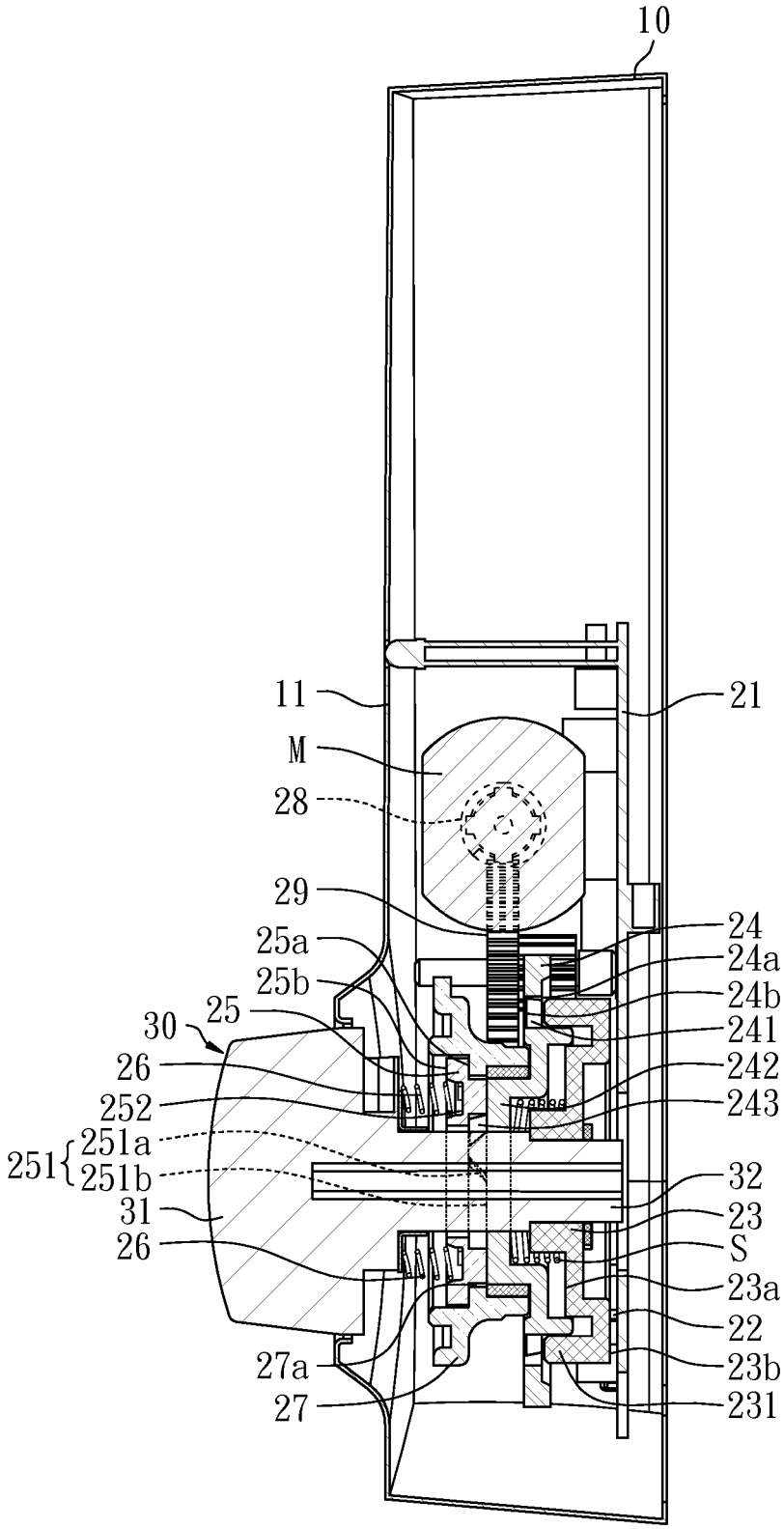
FIG. 6A-6F is a portion of motion sectional view of locking the electro-mechanical lock assembly with electric control manner.
Figure 6B:
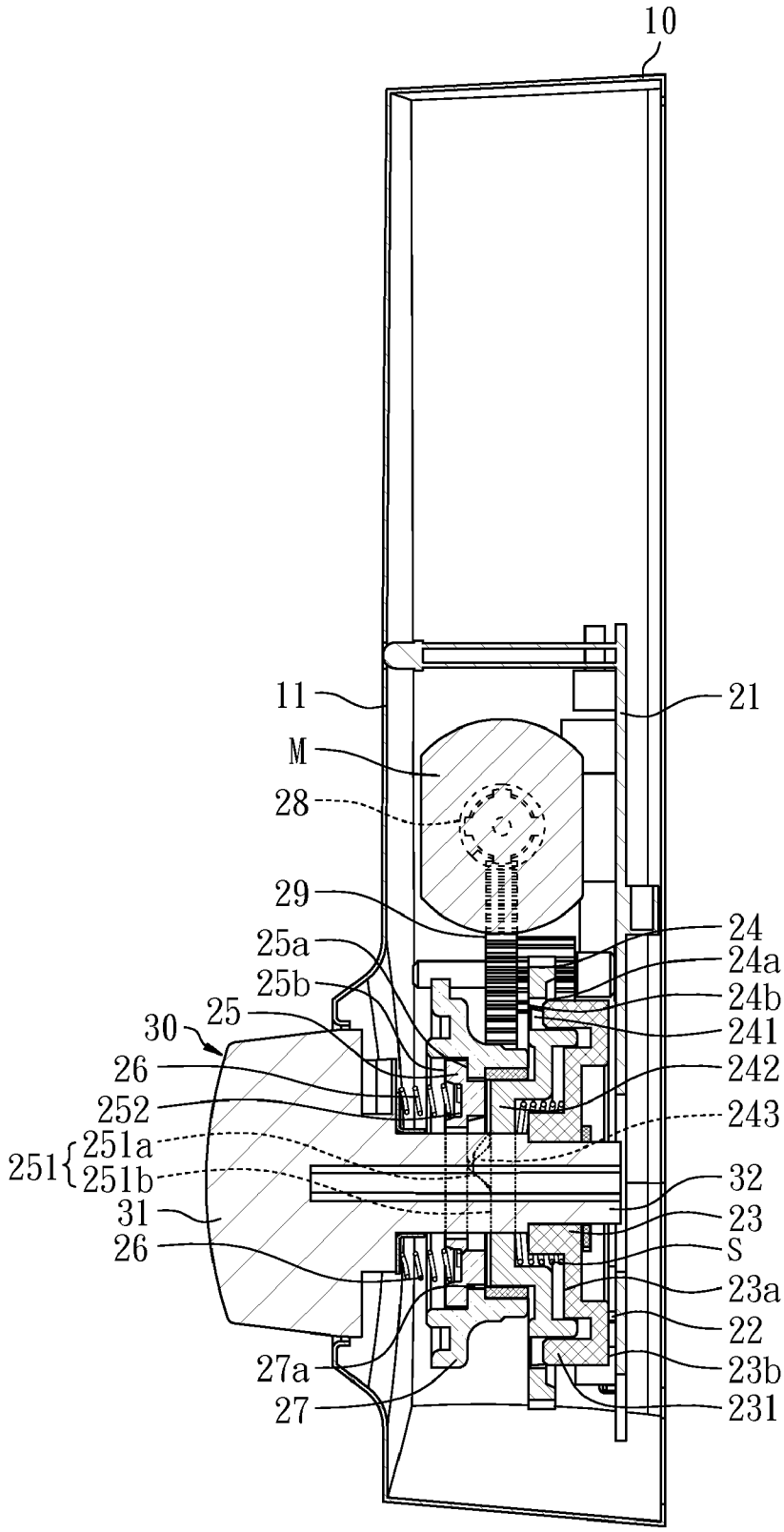
Figure 6C:
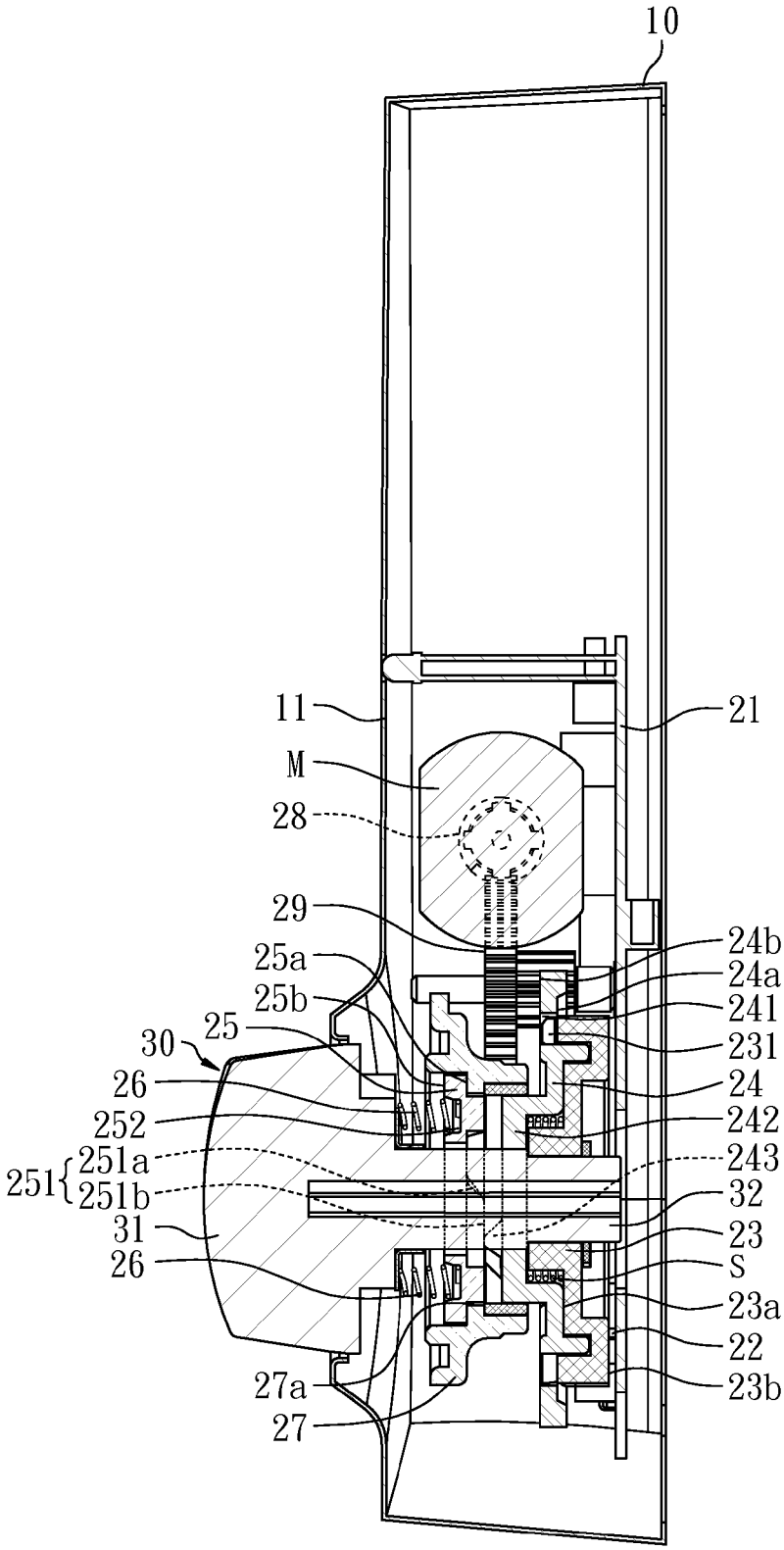
Figure 6D:
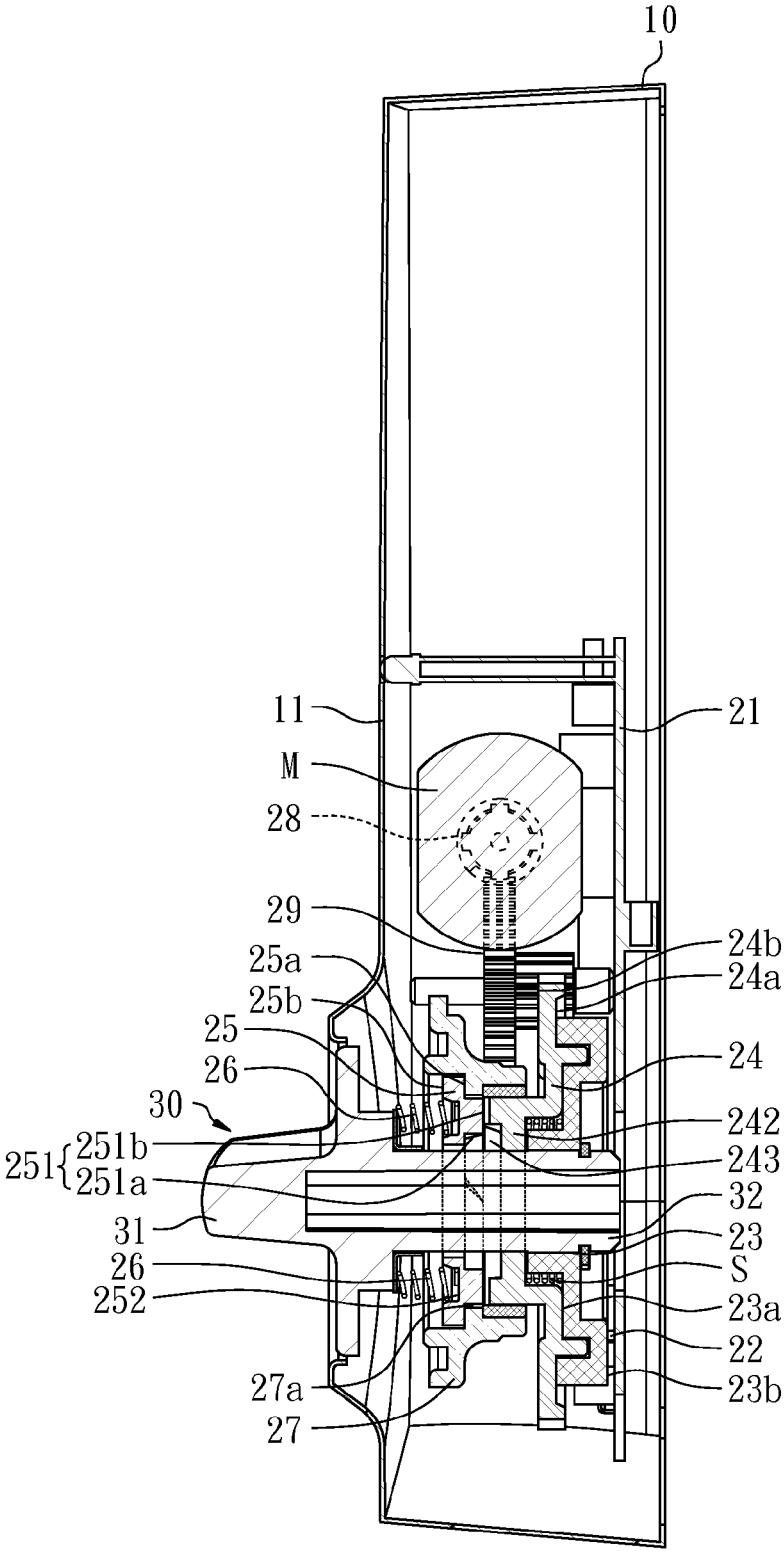
Figure 6E:
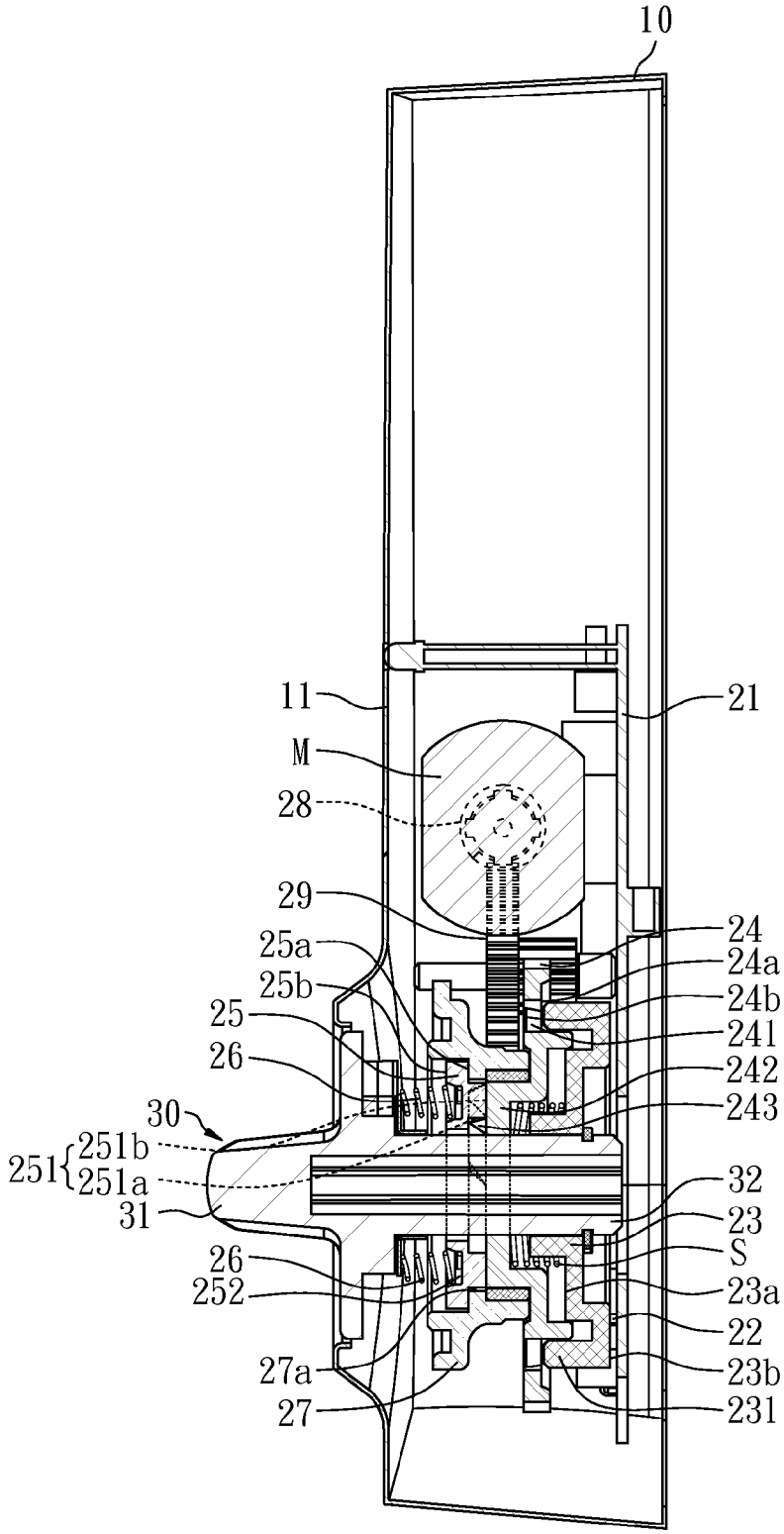

With reference to FIG. 5A-5F and FIG. 6A-6F, an action about that the electro-mechanical lock assembly performs locking operation with electric control manner is shown. First, FIGS. 5A and 6A show elements of the electro-mechanical lock structure in unlocking state, in which at least one press protrusion 232 of the rotatable member 23 corresponds to the control switch 22 and the sloping block 243 of the clutch gear 24 corresponds to the guiding block 251 of the position member 25. Besides, the electro-mechanical lock assembly is turned clockwise to perform locking operation in this embodiment and the control switch 22 is applied as a locking/unclocking switch, or it may also be modified to turn counterclockwise in another case. Next, with reference to FIGS. 5B and 6B, when user utilizes a remote controller or a key assembly (both are not shown in the drawings) to drive the electro-mechanical lock assembly, the motor M will start to drive the worm wheel 28 rotating and further drive the double-layer gear 29 and the clutch gear 24 to rotate that makes the sloping block 243 of the clutch gear 24 contact against the guiding block 251 of the position member 25. In this embodiment, the sloping block 243 of the clutch gear 24 will contact against the slope 251*a* of the guiding block 251 and then moves toward the top surface 251*b* of the guiding block 251, in which the clutch gear 24 will move toward the rotatable member 23 along the spindle 32 and the axis 10*a*. With reference to FIGS. 5C and 6C, when the sloping block 243 of the clutch gear 24 contacts against the top surface 251*b* of the guiding block 251, the second coupling portion 241 (catching slot) of the clutch gear 24 moves along the spindle 32 to catch with the first coupling portion 231 (bump) of the rotatable member 23 and drives the rotatable member 23 to rotate thereby allowing at least one press protrusion 232 of the rotatable member 23 to actuate the control switch 22 first time. Next, with reference to FIGS. 5D and 6D, another press protrusion 232 of the rotatable member 23 will actuate the control switch 22 second time to switch the electro-mechanical lock assembly to locking state when the clutch gear 24 drives the rotatable member 23 turning clockwise to a predetermined angle, in which the predetermined angle may be set between 60° and 90° in this embodiment. Moreover, with reference to FIGS. 5E and 6E, in order to prevent mutual interference between electric and manual control operations, the motor M remains leading the clutch gear 24 to rotate after the control switch 22 is actuated twice by the press protrusion 232 until the sloping block 243 of the clutch gear 24 moves away from the top surface 251*b* and the slope 251*a* of the guiding block 251. The restoration spring S pushes and makes the clutch gear 24 restore during the operating process mentioned above and simultaneously catching state between the second coupling portion 241 (catching slot) of the clutch gear 24*b* and the first coupling portion 231 (bump) of the rotatable member 23 is released, so when the manual control member 30 is applied to drive the rotatable member 23 rotating, an interference caused by the clutch gear 23 is evitable. Similarly, when the electro-mechanical lock assembly is switched to unlocking state with electric control manner, the motor M will drive the clutch gear 24 to rotate counterclockwise thereby driving the rotatable member 23 to rotate counterclockwise, that allows the press protrusions 232 of the rotatable member 23 to actuate the control switch 22 twice capable of switching to unlocking state.

Figure 6F:
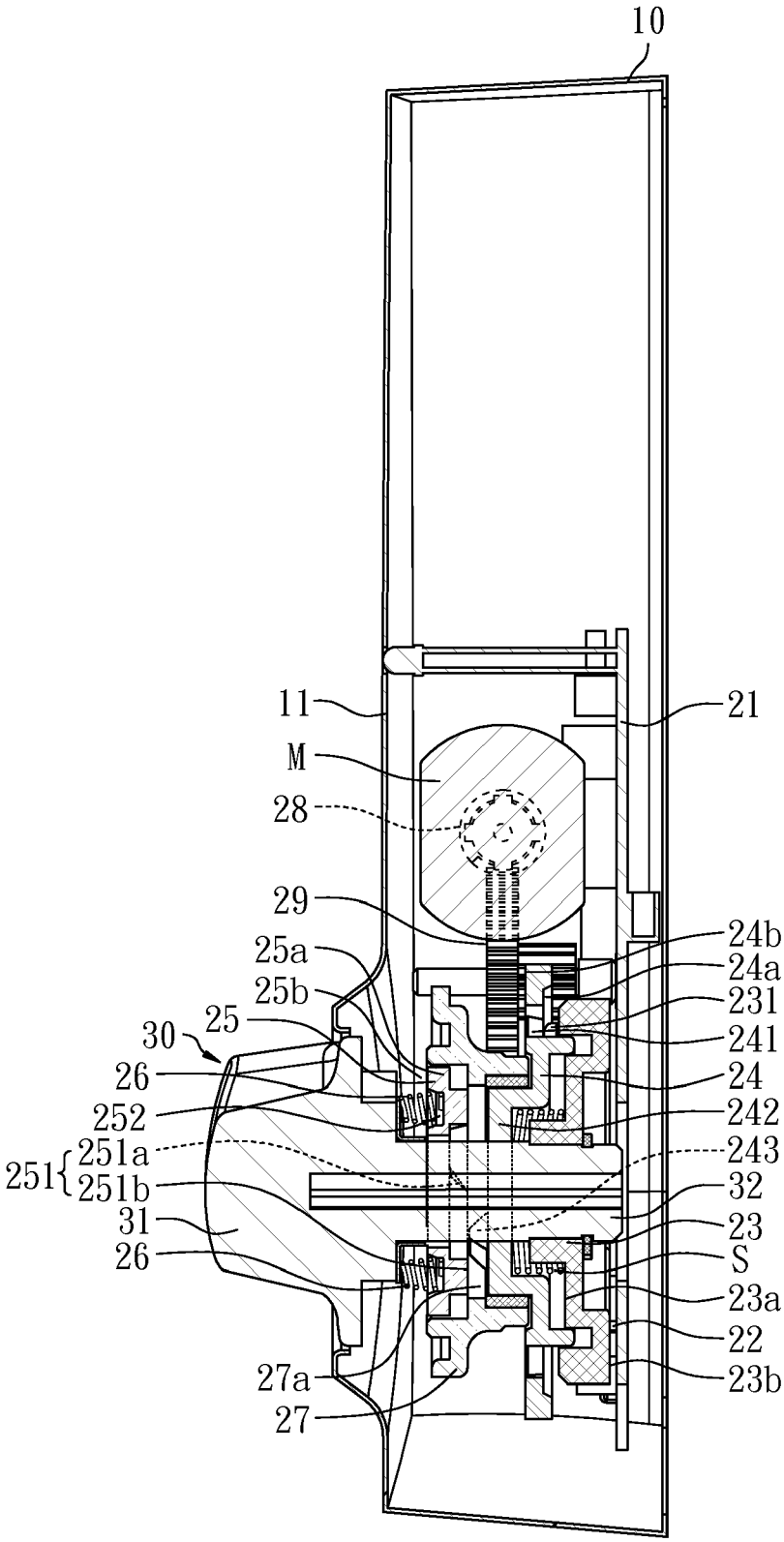

Furthermore, reference to FIGS. 5F and 6F, when the electro-mechanical lock assembly is switched to locking or unlocking state, the sloping block 243 of the clutch gear 24 stops moving before it moves away from the top surface 251*b* or the slope 251*a* of the guiding block 251 because the latch is obstructed, so that the position member 25 is modified to be movable axially in this embodiment for preventing a problem that the electro-mechanical lock assembly is deadlock from occurring. Hence, if the case mentioned above occurs, the manual control member 30 is used to turn the rotatable member 23, in which the first coupling portion 231 (bump) of the rotatable member 23 will moves away from the second coupling portion 241 (catching slot) of the clutch gear 24 to contact against the first lateral 24*a* and push the clutch gear 24, thereby allowing the clutch gear 24 to move toward the position member 25. Furthermore, the sloping block 243 of the clutch gear 24 also pushes the guiding block 251 of the position member 25 to make the position member 25 move toward the base 11 and compress the elastic member 26. Because the clutch gear 24 and the position member 25 are movable axially to provide a space for accommodation, the manual control member 30 can smoothly turn the rotatable member 23 to unlock without deadlock. Accordingly, operating smooth for electric and manual control may be improved substantially because of the link having excellent coordination among the clutch gear 24, position member 25 and the rotatable member 23 in accordance with the present invention.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. An electro-mechanical lock assembly comprising:

a casing having a base and an axial bore formed at the base;

a manual control member installed penetrating the axial bore of the casing having a knob and a spindle coupled to the knob; and an electric control mechanism disposed within the casing comprising a control switch, a rotatable member capable of actuating the control switch, a clutch gear capable of driving the rotatable member, a position member capable of controlling movement of the clutch gear and a motor capable of driving the clutch gear, wherein the rotatable member is coupled to the spindle of the manual control member and has at least one first coupling portion, the clutch gear has at least one second coupling portion corresponding to the first coupling portion, the second coupling portion is capable of being moved along the spindle to catch with the first coupling portion of the rotatable member, wherein the clutch gear has at least one sloping block, the position member has at least one guiding block, the sloping block of the clutch gear is capable of contacting against the guiding block of the position member.

2. The electro-mechanical lock assembly in accordance with claim 1, wherein the rotatable member has a first surface facing the clutch gear and a second surface facing the control switch, the first coupling portion is formed on the first surface.

3. The electro-mechanical lock assembly in accordance with claim 2, wherein the first coupling portion of the rotatable member is a bump.

4. The electro-mechanical lock assembly in accordance with claim 2, wherein the rotatable member has a peripheral wall and a plurality of press protrusions formed on the peripheral wall.

5. The electro-mechanical lock assembly in accordance with claim 1, wherein the clutch gear has a first lateral facing the rotatable member and a second lateral facing the position member, the second coupling portion is a catching slot recessed from the first lateral.

6. The electro-mechanical lock assembly in accordance with claim 5, wherein the catching slot communicates with the first lateral and the second lateral.

7. The electro-mechanical lock assembly in accordance with claim 5, wherein the electric control mechanism further comprises a restoration spring, the clutch gear has a cavity recessing from the first lateral, the restoration spring is disposed at the cavity.

8. The electro-mechanical lock assembly in accordance with claim 7, wherein one end of the restoration spring contacts against the rotatable member.

9. The electro-mechanical lock assembly in accordance with claim 1, wherein the clutch gear has a ring protrusion projecting from the second lateral, the sloping block is formed on the ring protrusion.

10. The electro-mechanical lock assembly in accordance with claim 1, wherein the position member has a first side facing the clutch gear and a second side facing the base, the guiding block projects from the first side.

11. The electro-mechanical lock assembly in accordance with claim 10, wherein the electric control mechanism further comprises at least one elastic member disposed between the base and the position member, one end of the elastic member contacts against the position member and another end contacts against the base.

12. The electro-mechanical lock assembly in accordance with claim 11, wherein the position member has at least one chamfer recessed form the second side, one end of the elastic member is disposed at the chamfer.

13. The electro-mechanical lock assembly in accordance with claim 1, wherein the electric control mechanism further comprises a fixing base to affix the position member at the base.

14. The electro-mechanical lock assembly in accordance with claim 13, wherein the fixing base has an opening to expose the guiding block of the position member.

15. The electro-mechanical lock assembly in accordance with claim 1, wherein the guiding block of the position member has a slope, the sloping block of the clutch gear contacts against the slope.

16. The electro-mechanical lock assembly in accordance with claim 1, wherein the guiding block of the position member has a top surface, the sloping block of the clutch gear contacts against the top surface.

17. The electro-mechanical lock assembly in accordance with claim 1, wherein the clutch gear has a central bore, the second coupling portion is formed at the outside of the central bore.

* * * * *